United States Patent [19]

Bette

[11] 4,117,826

[45] Oct. 3, 1978

[54] WOOD BURNING STOVE

[76] Inventor: Joseph A. Bette, R.F.D. #4, Southbury, Conn. 06488

[21] Appl. No.: 775,254

[22] Filed: Mar. 7, 1977

[51] Int. Cl.[2] ..... F23M 5/00

[52] U.S. Cl. ..... 126/65; 126/93; 126/146

[58] Field of Search ..... 126/60, 64, 65, 144, 126/146, 98

[56] References Cited

U.S. PATENT DOCUMENTS

| | | | |
|---|---|---|---|
| 345,876 | 7/1886 | Berry | 126/144 |
| 610,026 | 8/1898 | Brooke | 126/98 |
| 661,707 | 11/1900 | Sanford | 126/146 |
| 803,036 | 10/1905 | Vosler | 126/58 |
| 858,790 | 7/1907 | Breen | 126/19 |
| 1,008,698 | 11/1911 | Coulston | 126/146 X |
| 2,399,490 | 4/1946 | Lange | 126/146 X |
| 2,419,379 | 4/1947 | Tindell, Jr. | 126/146 X |
| 4,051,831 | 10/1977 | Schellens | 126/76 |

*Primary Examiner*—William E. Wayner
*Assistant Examiner*—William E. Tapolcai, Jr.
*Attorney, Agent, or Firm*—Barlow & Barlow

[57] ABSTRACT

A wood or coal burning metal stove formed with a base, a top wall, a casing between the two and a lining extending completely around the lower part of the casing, the base having no openings for draft, but the draft openings being thru a casing door and the lower edge of the liner. Bolts between the liner and casing to hold the top wall base and casing in assembled relation. The casing is assembled in sections with an expansion joint for the expansion of the various side wall sections of the casing.

3 Claims, 7 Drawing Figures

WOOD BURNING STOVE

BACKGROUND OF THE INVENTION

Stove casings with inner liners have been formed previously. Usually, however, the fire box has a grate upon which the burnable material such as logs or coal rests. Sometimes a liner is formed with an arrangement so that the air will circulate downwardly between the liner and the outer casing from the fire box, as shown in U.S. Pat. No. 8,949, entering thru the grate on which the fire rests or increasing the path of flow of the combusted gases to the flue or chimney as in U.S. Pat. Nos. 719,827 and 58,477. All of these structures place the material to be burned on a grate. Stoves with no grate as, for example, seen in U.S. Pat. No. 69,837, tend to provide poor combustion.

SUMMARY OF THE INVENTION

The stove of the instant invention is constructed to radiate the greatest possible heat and to provide a structure in which combustion is efficiently carried out.

This is accomplished by providing a structure comprising a casing extending between the base and top wall within which there is a liner extending horizontally completely about and spaced from the inner wall of the casing. Bolts extend between the liner and casing to hold the top and bottom walls and casing in assembled relation. Draft openings are provided in the liner by forming notches in the bottom of the liner thru which the cooler air which strikes the outer casing above the liner descends in the space between the liner and the casing and enter the draft openings formed by these notches in the lower edge of the liner, thus re-circulating the air in the stove before it passes out of the flue. The casing is provided in several sections with the edge of one of the sections folded back and forth upon itself to receive the single ply thickness of the edge of another section of the casing for providing an expansion joint in the casing when the same becomes heated and expands.

DESCRIPTION OF THE PREFERRED EMBODIMENT

Figure 1:
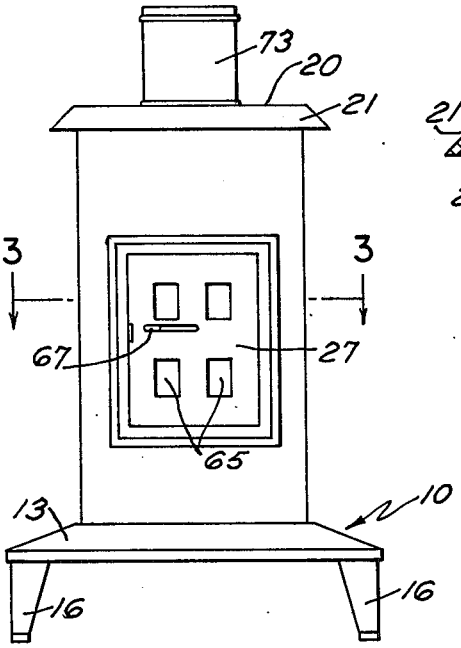
FIG. 1 is a front elevation of the stove.
Figure 6:
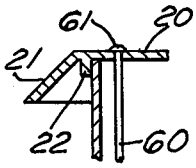
FIG. 6 is a fragmental sectional view illustrating one of several lugs for guiding the liner relative to the top wall.
Figure 2:
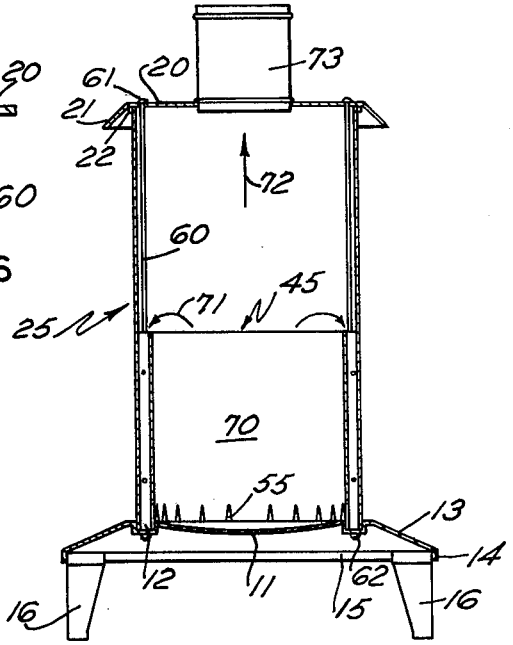
FIG. 2 is substantially a central vertical section of the stove.

10 designates the base which as shown in section in FIG. 2 comprises a dished shaped bottom wall 11 about which there is an encircling recess 12 and from the outer edge of the recess there is a downwardly slanted skirt portion 13 with a flange 14. A rim 15 fits within the flange 14 of the skirt 13 and is provided with legs 16 to support the base plate 10 above the floor or surface upon which the stove is to rest. A top plate 20 is generally flat and horizontal and may be provided with an opening with a removable circular cover and lifter and from its outer edges it is inclined downwardly as at 21. Lugs 22 (FIG. 6) extend downwardly from the under surface of top plate 20.

Figure 3:
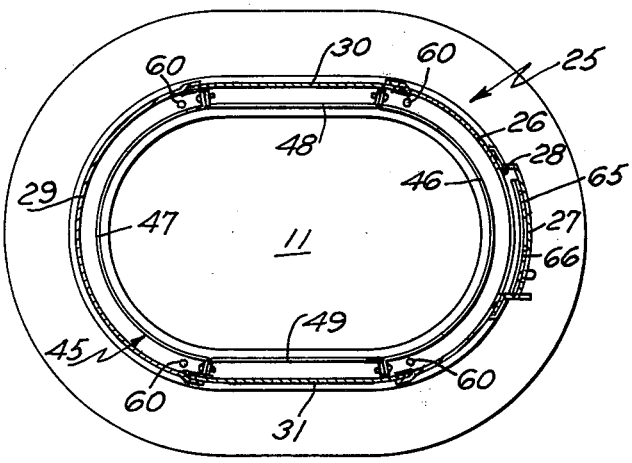
FIG. 3 is a horizontal section taken thru the door of the stove.
Figure 5:
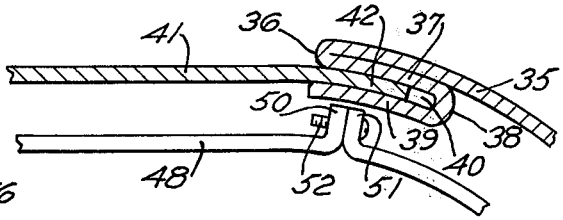
FIG. 5 is a horizontal section above the liner looking downwardly and showing the expansion joint of the casing.

A casing designated generally 25 is formed of a plurality of sections comprising a front section 26 in which there is a door 27 hinged as at 28, a back section 29 and side sections 30 and 31. These different sections, as shown in FIG. 3, are of sheet stock, and an expansion joint is formed between the sections as they fit together. As shown in FIG. 5, the wall 35 is doubled back on itself as at 36 forming a layer or ply 37 and again bent back at 38 forming a ply 39. Ply 39 is spaced from the ply 37 so as to provide a socket or space 40 between the plies 37 and 39 for the reception of the single ply or wall 41 of an adjacent section which is slightly curved and fitted therein as at 42. This portion 42 does not extend the full depth of the socket 40, thus allowing for a sliding action between the ply 42 and plies 37, 39 in the socket 40 for the expansion or contraction of the casing as it heats or cools.

Figure 7:
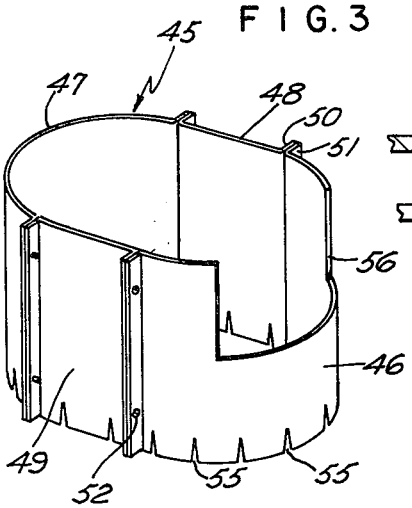
FIG. 7 is a perspective view of the liner showing the cutout adjacent the door in the casing.

Within this casing 25 there is a liner 45 which is of generally the shape of the casing in its completed form (see FIG. 7) but which is also formed of sections, there being a front section 46, a back section 47, and side sections 48 and 49. Each of these sections is flanged outwardly as shown in FIG. 5, there being meeting flanges 50 and 51 with a screw or fastener 52 passing thru these flanges so as to secure them together. This sheet stock liner may expand or contract somewhat as it heats or cools. The liner 45 is provided with V-shaped notches 55 about its lower edge while the front section 46 is provided with a cutout 56 adjacent the door 27 for the entrance of a log, coal or solid burning substance which is to be placed within the liner and on to the base portion 11 which portions together form the fire box of the stove.

Figure 4:
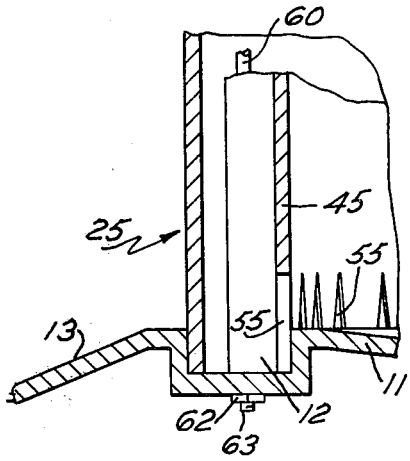
FIG. 4 is a fragmental detail section on a larger scale showing the relationship of the bottom wall, the casing and the liner and also one end of a bolt which hold the parts assembled.

The lower portions of the liner 45 and the casing 25 rest within the recess 12 as seen more clearly in FIG. 4, while bolts 60 headed above the top wall and extending between the liner and the casing and thru the base in the recess 12 serve to hold the casing, base, and top wall assembled. The bolt 60 has a head 61 on the outer surface of the top wall while it has a nut 62 threaded onto the end 63 of the bolt 60 as it passes thru the recess portion 12 of the base. Four of these bolts 60 as seen in FIG. 3 serve to hold the parts assembled. As the casing is placed in position between the base and the top wall, this casing 25 fits within the lug 22 on the top wall so as to properly position the casing with respect to the top wall while it is properly positioned with reference to the base by reason of the recess 12 into which it extends. It will also be noted that the notches 55 are of a height from the edge of the liner so as to extend a substantial distance above the curved wall 11 (FIGS. 2 and 4) of the base to allow for the passage of air therethrough.

In operation, air may enter thru the door 27 which has draft openings 65 and closure 66 operated by button 67 to allow the desired amount of air to supply oxygen to the burning material in the fire box designated 70, and as the heated combusted gases rise, they will impinge on the casing walls above the liner 45 and be cooled and descend downwardly along the casing as seen by arrow 71 to descend through the space between the liner and casing enter thru the draft openings 55 and again pass thru the fire box and eventually may pass out as shown by arrow 72 thru the flue or chimney 73 which is located adjacent the back section 29 of the casing.

I claim:

1. A stove comprising a generally horizontal imperforate bottom wall, a generally horizontal top wall, a generally vertical outer casing extending between said bottom and top wall, a liner within said casing extending completely about the same and spaced therefrom to provide a draft conduit through the space, said liner resting on said bottom wall and of a vertical extent less than said casing to be spaced from the top wall, said liner providing with said bottom wall a fire box, Serial No. 775,254 said bottom wall having an upwardly opening recess with opposite upstanding spaced walls, said casing and liner being located in said recess between said upstanding walls, said liner being provided with draft openings adjacent its lower edge for the entrance of air therethrough, means to provide the entrance of air through said casing to the conduit formed by said liner whereby air is conveyed to said draft openings and to said fire box, and means to direct the heated gases from the casing.

2. A stove as in claim 1 wherein the draft openings in said liner are notches in the lower edge of the liner extending to a height greater than the depth of said recess.

3. A stove as in claim 1 wherein the top wall has downwardly extending lugs cooperating with the upper marginal edge of the casing to assist in locating the casing with reference to the top wall.

* * * * *